US008098864B2

(12) United States Patent
Saltykov

(10) Patent No.: US 8,098,864 B2
(45) Date of Patent: Jan. 17, 2012

(54) RECEIVER TUBE AND RETAINING CLAMP ASSEMBLY FOR A HEARING INSTRUMENT RECEIVER

(75) Inventor: Oleg Saltykov, Fairlawn, NJ (US)

(73) Assignee: Siemens Hearing Instruments, Inc., Piscataway, NJ (US)

( * ) Notice: Subject to any disclaimer, the term of this patent is extended or adjusted under 35 U.S.C. 154(b) by 917 days.

(21) Appl. No.: 12/120,395

(22) Filed: May 14, 2008

(65) Prior Publication Data

US 2009/0285427 A1 Nov. 19, 2009

(51) Int. Cl.
*H04R 25/00* (2006.01)

(52) U.S. Cl. ..... 381/324; 381/328

(58) Field of Classification Search ..... 381/312, 381/322, 324, 325, 327, 328, 330
See application file for complete search history.

(56) References Cited

U.S. PATENT DOCUMENTS

| | | | |
|---|---|---|---|
| 6,766,030 | B1 | 7/2004 | Chojar |
| 7,054,457 | B2 | 5/2006 | Saltykov |
| 7,076,074 | B2 | 7/2006 | Gebert et al. |
| 2004/0264723 | A1 | 12/2004 | Saltykov |
| 2005/0074138 | A1 | 4/2005 | Saltykov |
| 2007/0036378 | A1 | 2/2007 | Saltykov |

FOREIGN PATENT DOCUMENTS

| | | |
|---|---|---|
| EP | 1 988 475 | 11/2008 |

OTHER PUBLICATIONS

European Search Report in Application No. 09158907.7 dated Aug. 3, 2009.

*Primary Examiner* — Elvin G Enad
*Assistant Examiner* — Andrew R Millikin
(74) *Attorney, Agent, or Firm* — Francis G. Montgomery

(57) ABSTRACT

A receiver tube for a hearing instrument may be securely affixed to the instruments receiver with a retaining clamp. Such an arrangement facilitates assembly and repair, and provides a positive means for the securing the receiver tube.

10 Claims, 7 Drawing Sheets

RECEIVER TUBE AND RETAINING CLAMP ASSEMBLY FOR A HEARING INSTRUMENT RECEIVER

CROSS-REFERENCE TO RELATED APPLICATIONS

This application is related to commonly-owned U.S. patent applications Ser. No. 10/610,449, filed Jun. 30, 2003, and titled "Feedback Reducing Receiver Mount and Assembly," Ser. No. 10/945,704, filed Sep. 21, 2004, and titled "Feedback Reducing Receiver Mount and Assembly," and Ser. No. 12/060,494, filed Apr. 1, 2008, and titled "Composite Receiver Tube for a Hearing Instrument," and U.S. Pat. No. 7,054,457, issued May 30, 2006, and titled "Hearing instrument receiver mounting arrangement for a hearing instrument housing," all incorporated herein by reference.

BACKGROUND AND SUMMARY OF THE INVENTION

A receiver tube for a hearing instrument receiver, the component that generates the sound heard by the user of the hearing instrument, connects the output of the receiver with the outside of the shell, conveying the sound from the receiver to the user's ear canal. Some receivers, such as the kind shown in U.S. Patent application Ser. No. 11/182,151, filed Jul. 15, 2005, and titled "Shock resistant and vibration isolated electroacoustical transducer assembly," incorporated herein by reference, have an opening on one face of the unit from which sound exits and the receiver tube is positioned over that opening. To provide a secure attachment for such a receiver tube to the receiver, a retaining clamp may be provided to hold the receiver tube in place.

DESCRIPTION OF THE INVENTION

Figure 1:
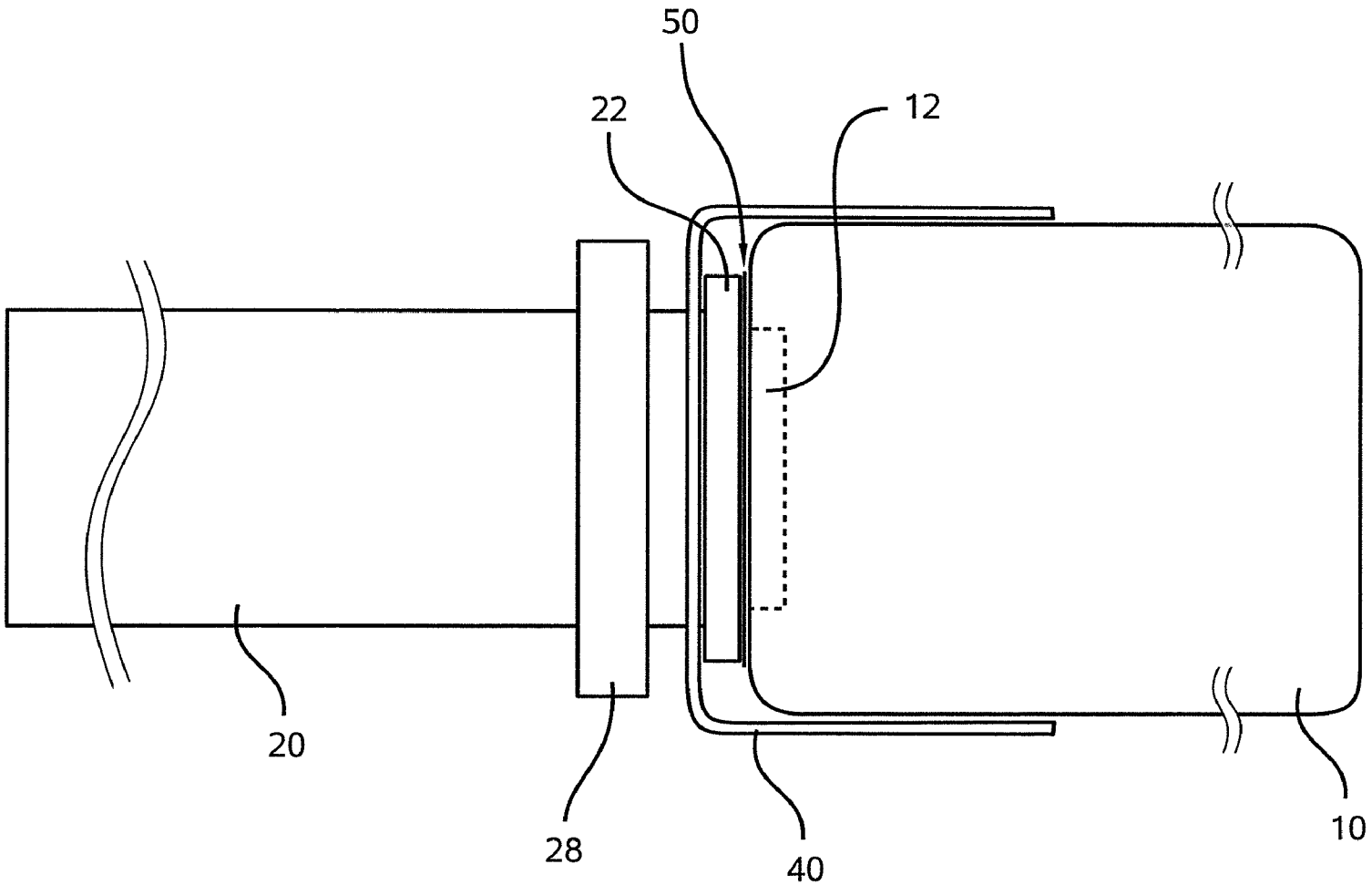
FIG. 1 is a drawing of a receiver, a receiver tube, and a retaining clamp.

A receiver 10 for a hearing instrument is shown together with a receiver tube 20 and a U-shaped retaining clamp 40 in FIG. 1. The receiver tube 20 abuts the receiver 10 adjacent a receiver opening 12, shown in phantom, that allows the audio output generated by the receiver 10 to pass to the receiver tube 20. The receiver 10 and the receiver tube 20 are illustrated apart in FIG. 2.

The receiver tube 20 has a flange 22 that mates with the receiver 10. One side of the flange 22 is a mating surface 24 that meets the surface 14 of the receiver 10 where the receiver opening 12 is located. The flange 22 also has an opposing surface 26 upon which the retaining clamp 40 rests.

Figure 2:
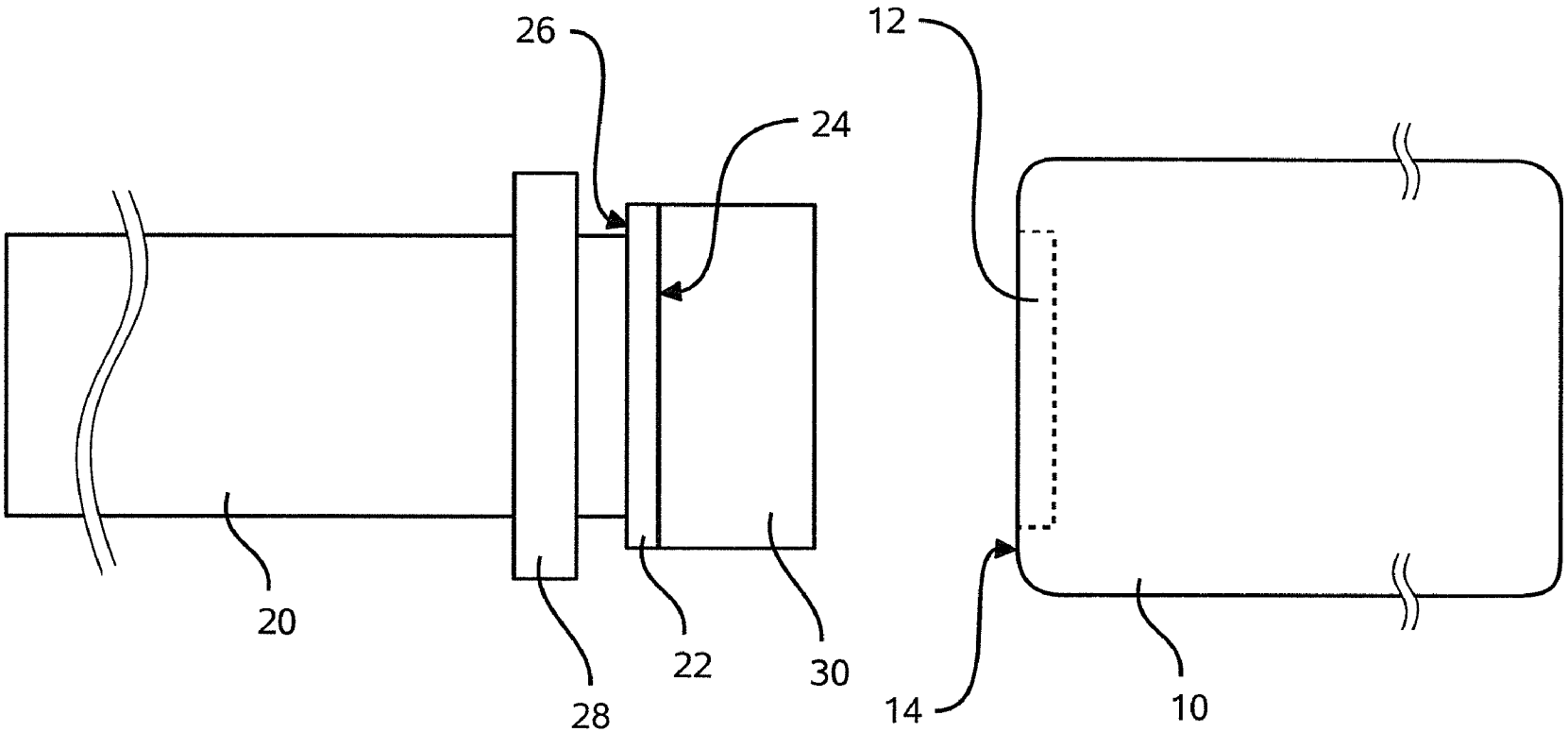
FIG. 2 is a drawing of the receiver and the receiver tube of FIG. 1.
Figure 3:
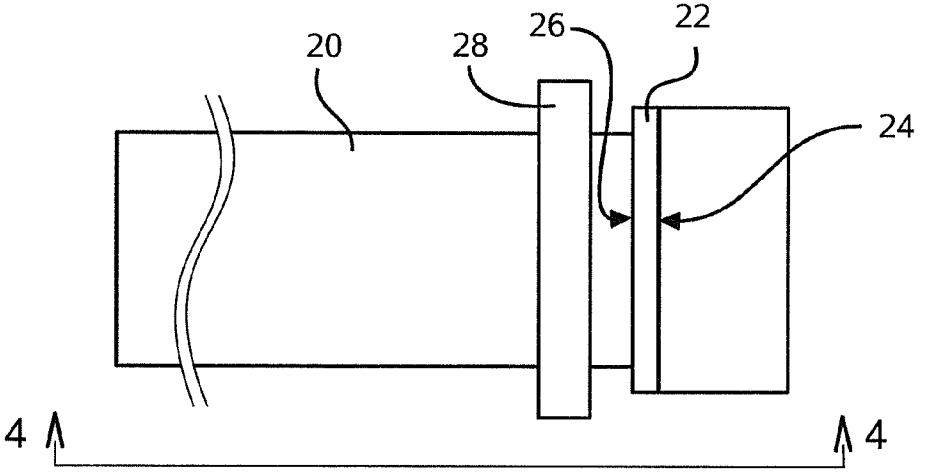
FIGS. 3 and 4 are drawings of the receiver tube of FIG. 1.

As discussed below, the receiver tube 20 may have an optional stopper flange 28 for positioning the receiver 10 and the receiver tube 20 within the hearing instrument. Also shown in FIG. 2 is an optional curved section 30 that extends from flange 22 to cover the receiver opening 12, which as here may be positioned near the edge of the surface of the receiver 10 abutting the flange 22.

A gasket 50 may be positioned between the receiver 10 and the receiver tube 20 to help hold and seal the receiver tube 20 to the receiver 10. For clarity of presentation, the gasket 50 is shown in the figures slightly apart from the adjacent components. Nevertheless, in actual construction, the retaining clamp 40, the receiver tube 20, the gasket 50, and the receiver 10 would be abut one another, providing a seal between adjacent elements of the hearing instrument.

Figure 4:
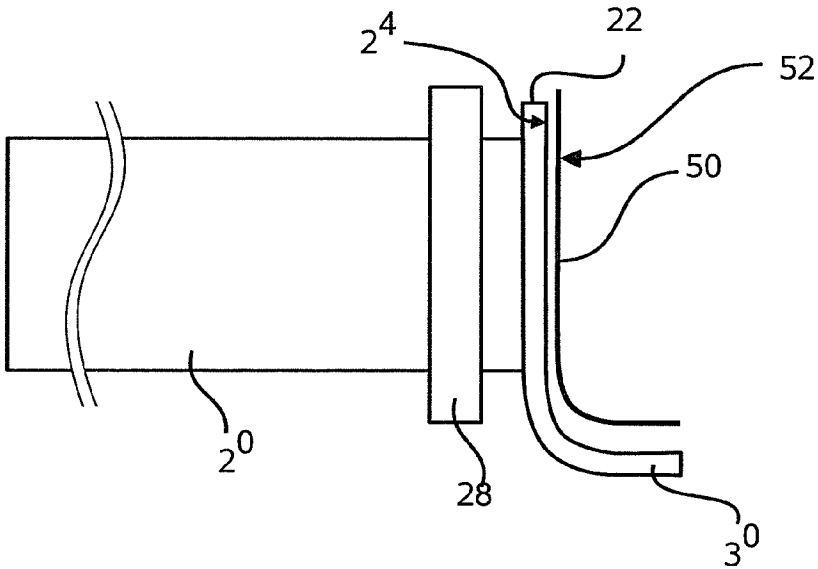

The gasket 50 may be fabricated from pressure-sensitive adhesive material such as a plastic tape with adhesive on two sides. Alternatively, if desired, one surface of the gasket 50 could be attached to the receiver tube 20 by gluing or otherwise affixing it to the mating surface 24 of the flange 22, while the other surface 52 (see FIG. 4) of the gasket 50 would have an adhesive thereon. A disposable, removable covering (not shown), provided on that other surface 52 to prevent the inadvertent collection of dust or dirt particles, would be removed and discarded, and this other (adhesive) surface 52 would then be attached to the receiver 10.

Figure 6:
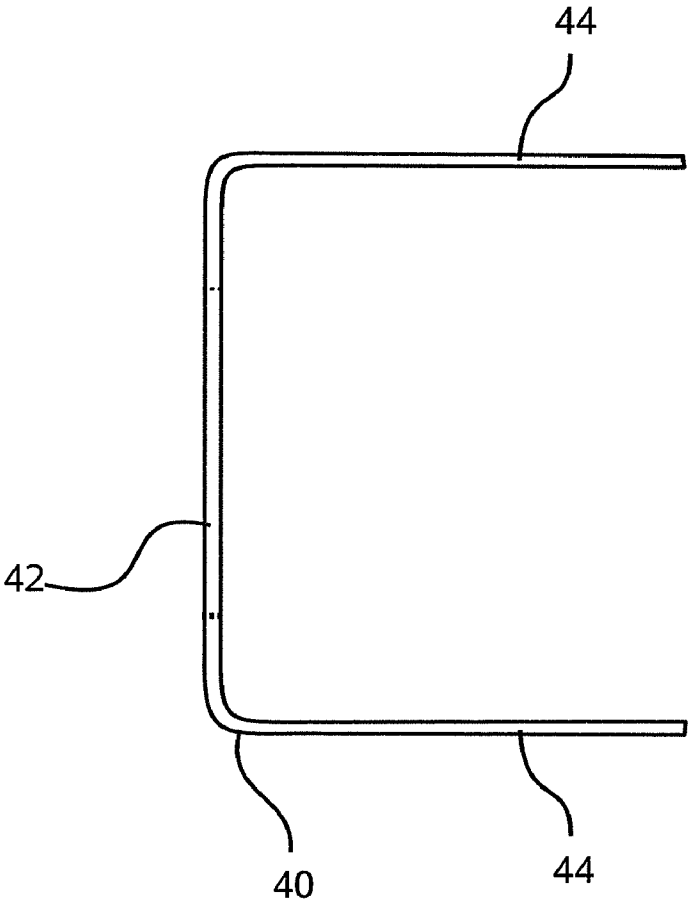
FIGS. 5 and 6 are drawings of the retaining clamp of FIG. 1.
Figure 5:
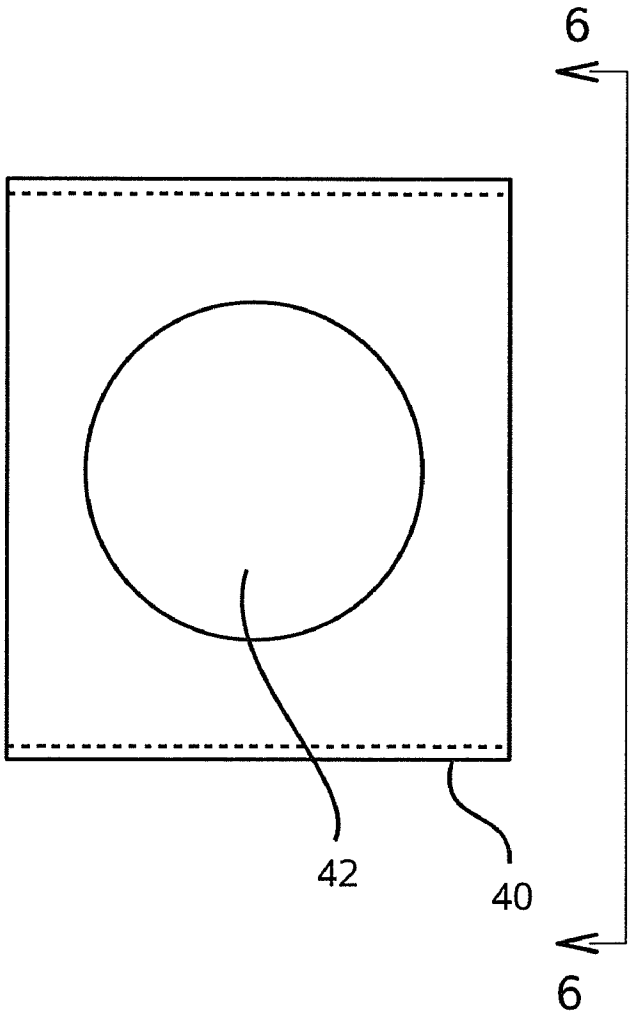
Figure 7:
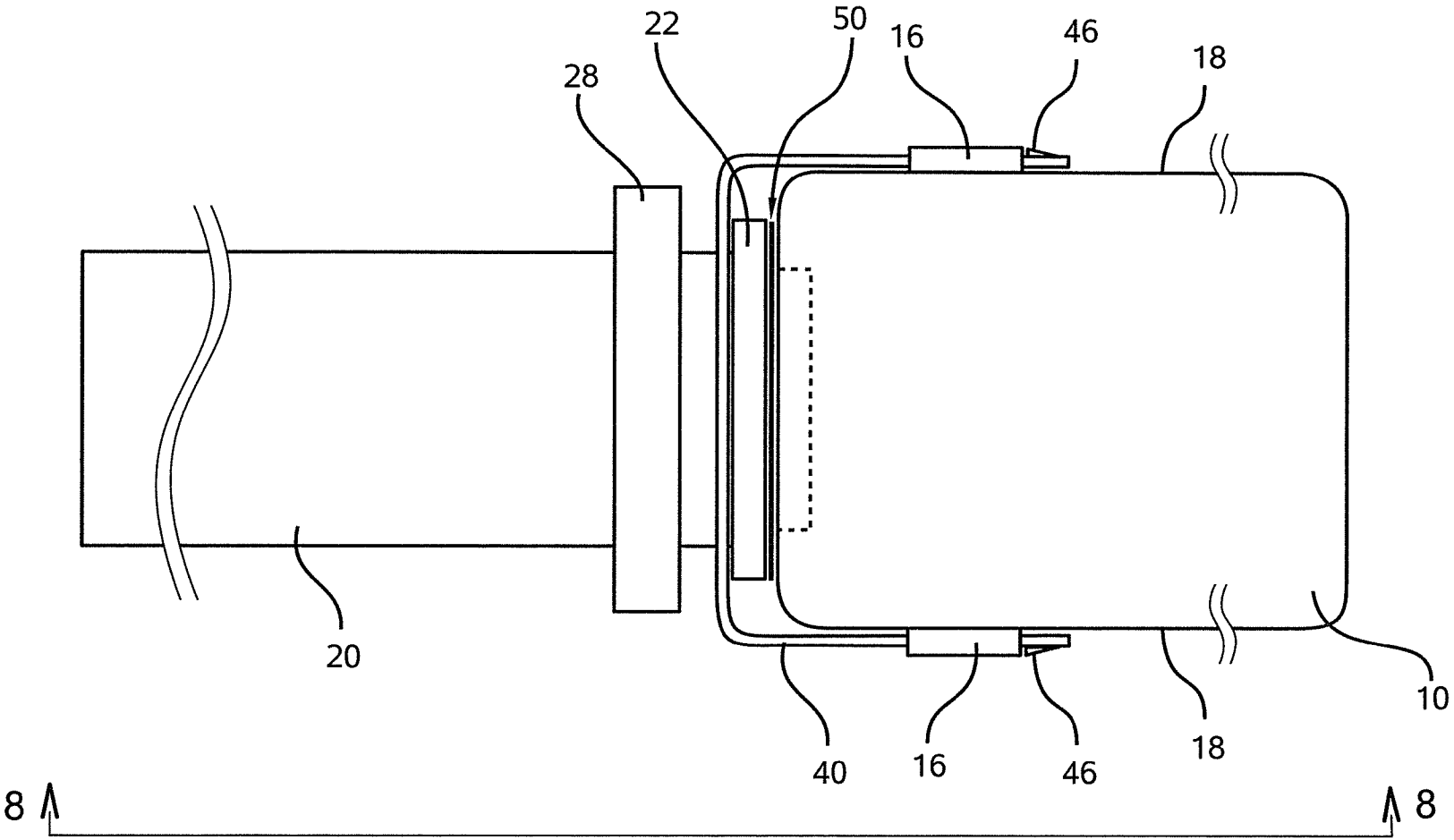
FIGS. 7 and 8 are side and elevation views of the receiver, the receiver tube, and the retaining clamp of FIG. 1, further illustrating the attachment of the retaining clamp to the receiver.
Figure 8:
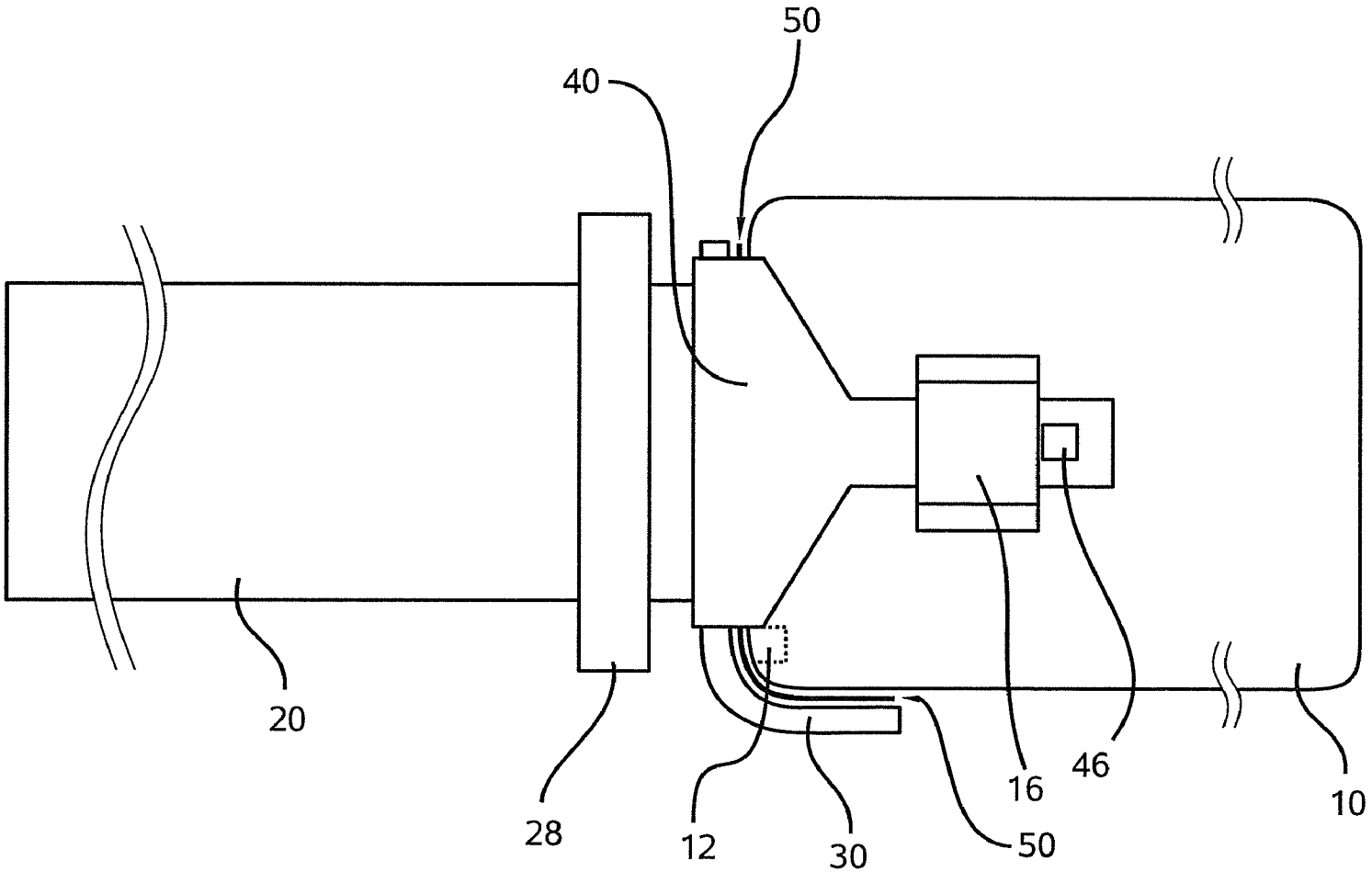

The U-shaped retaining clamp 40, shown by itself in FIGS. 5 and 6, encircles the receiver tube 20 and rests upon the opposing surface 26 of the flange 22. During assembly, the tube 10 is deformed such that the flange 22 can pass through the opening 42 (FIGS. 5 and 6). A securing mechanism is provided on the receiver 10 to receive and hold the retaining clamp 40. One suitable arrangement is illustrated in FIGS. 7 and 8. As shown there, the retaining clamp 40 has two legs 44 received by receptacles or sleeves 16 located on opposing sides 18 of the receiver 10. Each leg 44 has a detent 46 that releasably engages the sleeves 16. The legs 44 slip through the sleeves 16 and then the detents 46 catch and secure the retaining clamp 40 in place.

In lieu of the sleeves 16 and the detents 46 on the clamp 40, the legs 44 of the clamp 40 could be secured to the opposing sides 18 of the receiver 10 with an adhesive material, such as glue or a pressure-sensitive material.

Figure 9:
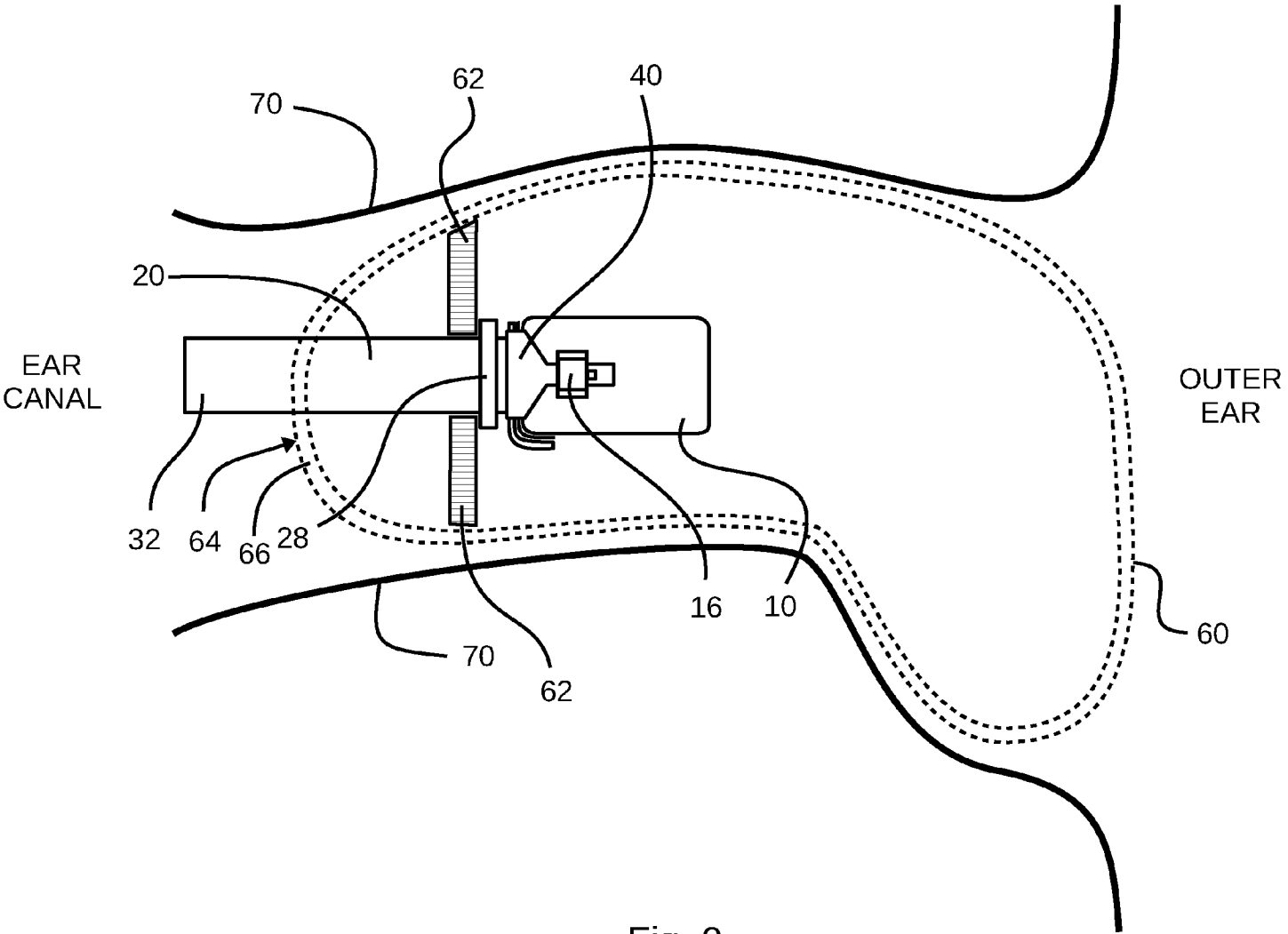
FIG. 9 illustrates the receiver, the receiver tube, and the retaining clamp of FIG. 1 within a shell residing in the ear canal of the user.

The receiver 10, receiver tube 20, and the retaining clamp 40 are shown within a shell 60 (shown in phantom), residing in the user's ear canal 70 in FIG. 9. A barrier 62, anchored within the shell 60, encircles the receiver tube 20 and abuts the stopper flange 28 when the tube 20 is inserted into the shell 60. After the receiver tube 20 has been installed in the shell 60, the end 32 of the tube 20 protruding from the shell 60 is typically trimmed flush with the outer surface 64 of the wall 66 of the shell 60.

The tube 20 may be fabricated from a synthetic material such as an elastomer or any other suitable material. One such elastomer is marketed by DuPont Dow Elastomers, L.L.C. under the trademark Viton. If Viton is used, such material having a hardness rating of 50 on the Shore A scale will be suitable.

The retaining clamp 40 may be fashioned from any suitable material such as metal including steel.

What is claimed is:

1. An assembly for a hearing instrument, comprising:

a hearing instrument receiver for generating an audio output;

a receiver tube for conveying the audio output of the hearing instrument receiver , the receiver tube comprising two ends and a flange positioned at one end of the tube, where the flange comprises a mating surface for attachment to the receiver and an opposing surface; and a U-shaped retaining clamp for securing the receiver tube to the hearing instrument receiver, where the retaining clamp rests on the opposing surface of the receiver tube flange and comprises a pair of opposing legs that secure the retaining clamp to the hearing instrument receiver.

2. An assembly as set forth in claim 1, where the receiver comprises receptacles that releasably receive and secure the legs of the retaining clamp.

3. An assembly as set forth in claim 2, where each leg of the retaining clamp comprises a detent that releasably engages the receptacle on the receiver.

4. An assembly as set forth in claim 1, where the retaining clamp is affixed to the receiver with an adhesive.

5. An assembly as set forth in claim 1, further comprising an adhesive gasket positioned between the hearing instrument receiver and the receiver tube.

6. A hearing instrument; comprising:

a shell, the shell comprising a wall;

a hearing instrument receiver, located within the shell, for generating an audio output;

a receiver tube for conveying the audio output of the hearing instrument receiver through the wall of the shell, the receiver tube comprising two ends and a flange positioned at one end of the tube, where the flange comprises a mating surface for attachment to the receiver and an opposing surface; and a U-shaped retaining clamp for securing the receiver tube to the hearing instrument receiver, where the retaining clamp rests on the opposing surface of the receiver tube flange and comprises a pair of opposing legs that secure the retaining clamp to the hearing instrument receiver.

7. A hearing instrument as set forth in claim 6, where the receiver comprises receptacles that releasably receive and secure the legs of the retaining clamp.

8. A hearing instrument as set forth in claim 7, where each leg of the retaining clamp comprises a detent that releasably engages the receptacle on the receiver.

9. A hearing instrument as set forth in claim 6, where the retaining clamp is affixed to the receiver with an adhesive.

10. A hearing instrument as set forth in claim 6, further comprising an adhesive gasket positioned between the hearing instrument receiver and the receiver tube.

* * * * *